US005899185A

United States Patent [19]

Ohtsubo

[11] Patent Number: 5,899,185

[45] Date of Patent: May 4, 1999

[54] METHOD OF INCREASING HEAT TRANSFER OF A FITTED MATERIAL OF A CYLINDER HEAD IN AN INTERNAL COMBUSTION ENGINE AND A FITTED PORTION OF THE FITTED MATERIAL

[75] Inventor: Kizuku Ohtsubo, Kawasaki, Japan

[73] Assignee: Fuji Oozx Inc., Japan

[21] Appl. No.: 08/893,424

[22] Filed: Jul. 11, 1997

Related U.S. Application Data

[63] Continuation-in-part of application No. 08/746,919, Nov. 18, 1996, abandoned.

[30] Foreign Application Priority Data

Nov. 25, 1994 [JP] Japan ..... 6-291599

[51] Int. Cl.[6] ..... F01L 3/00

[52] U.S. Cl. ..... 123/188.3; 123/188.9; 29/888.06; 29/888.061

[58] Field of Search ..... 123/188.3, 188.9; 29/888.061, 888.06

[56] References Cited

U.S. PATENT DOCUMENTS

| | | | |
|---|---|---|---|
| 2,517,114 | 8/1950 | Karcher et al. | 123/188.8 |
| 3,998,199 | 12/1976 | Melchior | 123/188.9 |
| 4,023,349 | 5/1977 | Warren | 60/39.6 |
| 4,124,220 | 11/1978 | Leone et al. | 277/502 |
| 4,530,322 | 7/1985 | Yamada et a.l | 123/183.3 |
| 4,554,897 | 11/1985 | Yamada et al. | 123/188.3 |
| 4,554,898 | 11/1985 | Yamada et al. | 123/188.3 |
| 4,556,022 | 12/1985 | Yamada et al. | 123/188.3 |
| 4,723,518 | 2/1988 | Kawasaki et al. | 123/188.8 |
| 4,763,876 | 8/1988 | Oda et al. | 251/359 |
| 4,787,736 | 11/1988 | Mori et al. | 251/368 |
| 5,295,461 | 3/1994 | Rao et al. | 123/188.9 |
| 5,372,103 | 12/1994 | Hatckett et al. | 123/188.3 |
| 5,435,280 | 7/1995 | Hackett et al. | 123/188.9 |
| 5,492,091 | 2/1996 | Russ | 123/188.3 |
| 5,586,530 | 12/1996 | Adachi et al. | 123/188.3 |
| 5,662,078 | 9/1997 | Adegawa | 123/188.3 |
| 5,692,726 | 12/1997 | Adachi et al. | 251/368 |

*Primary Examiner*—Erick R. Solis
*Assistant Examiner*—Hai Huynh
*Attorney, Agent, or Firm*—Ostrolenk, Faber, Gerb & Soffen, LLP

[57] ABSTRACT

A soldering layer is formed on a valve guide or valve seat and/or a holding bore of a cylinder head in an internal combustion engine. The solder can be melted below the highest temperature which the valve guide or valve seat reaches during operation of the internal combustion engine. The valve guide or valve seat is a press fit in the holding bore of the cylinder head, and with operation of the internal combustion engine, the soldering layer is melted to close gaps on the contacting surfaces between the holding bore and valve guide or valve seat. The soldering layer finally has a higher melting point than the highest temperature of the valve guide or valve seat as above. During operation of the engine, the soldering layer is not melted.

19 Claims, 4 Drawing Sheets

METHOD OF INCREASING HEAT TRANSFER OF A FITTED MATERIAL OF A CYLINDER HEAD IN AN INTERNAL COMBUSTION ENGINE AND A FITTED PORTION OF THE FITTED MATERIAL

This is a continuation-in-part of application Ser. No. 08/746,919 filed Nov. 18, 1996, now abandoned.

BACKGROUND OF THE INVENTION

The present invention relates to a method of increasing heat transfer of a fitted material of a cylinder head in an internal combustion engine and a fitted portion of the fitted material for which the method is carried out.

An exhaust bore of a cylinder head in an internal combustion engine is periodically opened and closed by a valve which moves up and down by a rocker arm and a coil spring.

A valve stem is slidably inserted in a tubular valve guide above an inlet of the exhaust hole. With moving up and down, a valve face of a valve head at the lower end of the valve is engaged on and disengaged from a valve seat fixed on the inlet of the exhaust hole.

The valve guide and the valve seat require high heat, wear and impact resistance, are made of heat resistant steel different from material of the cylinder head such as cast iron and light metal, and are strongly fixed in the exhaust hole of the cylinder head.

The valve guide and the valve seat called "fitted material" are highly finished and firmly engaged to fit on each of the inner surfaces of the exhaust hole of the cylinder head. But the fitted material and the exhaust hole are not thermally integral.

Even if finishing accuracy of the contacting surfaces is increased and even if strong and complete fitness is mechanically made, it is unavoidable to remain fine unevenness. Gaps in the unevenness cause level difference in heat transfer in the contacting surfaces, thereby making it insufficient to transfer heat of the fitted material to the cylinder head.

If the fitted material and the cylinder head are formed to thermally or metallurgically integral material, heat transfer of the fitted material will be clearly improved, thereby increasing durability of the fitted material and the cooling effect of the whole cylinder head.

It is an object of the present invention to provide a method of melting soldering material during initial operation of an internal combustion engine or heating at a desired temperature, but not melting thereafter, and to provide a fitted portion of fitted material.

BRIEF DESCRIPTION OF THE DRAWINGS

The object and features of the present invention will become more apparent from the following description with respect to embodiment as shown in the appended drawings as follows.

DETAILED DESCRIPTION OF PREFERRED EMBODIMENT

Figure 1:
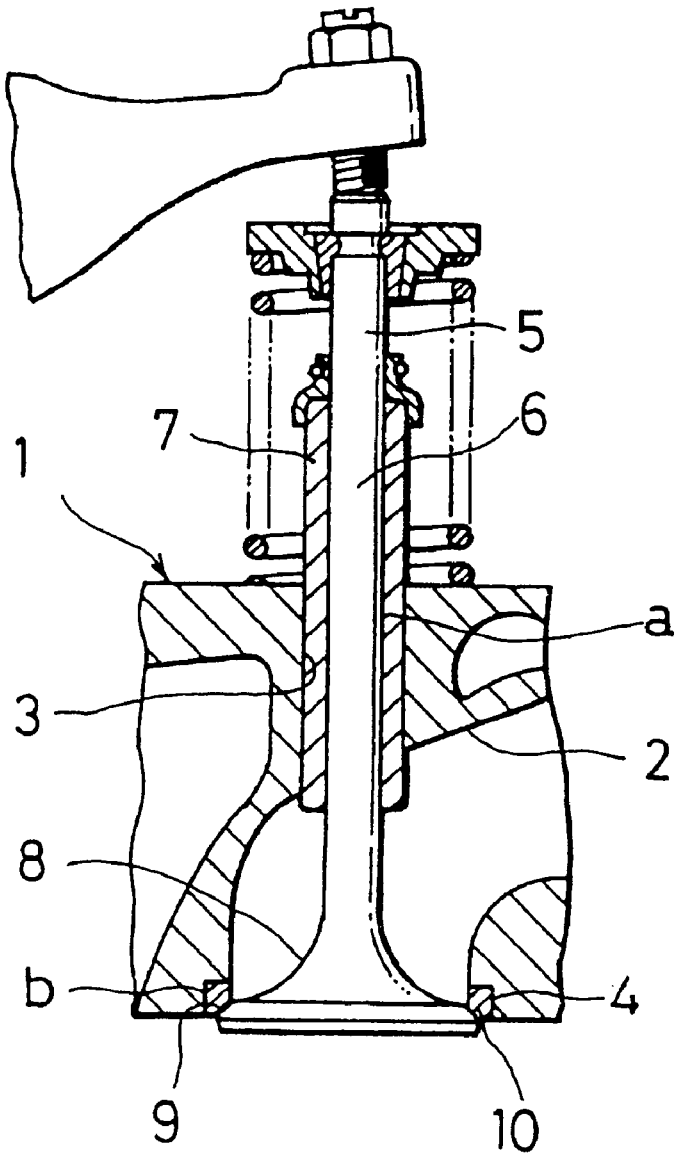
FIG. 1 is a vertical sectional view of a cylinder head in an internal combustion engine which includes the present invention.

In FIG. 1, an exhaust hole 2 in a cylinder head 1 has an upper holding bore 3 and a lower holding bore 4. In the upper holding bore 3, a tubular valve guide 7 in which a valve stem 6 of a valve 5 is slidably inserted is fixed. In the lower holding bore 4, a valve seat 10 on which a valve face 9 of a valve head 8 of the valve 5 is engaged is fixed.

On one or both of the contacting surfaces of the valve guide 7 and the upper holding bore 3, and on one or both of the contacting surfaces of the valve seat 10 and the lower holding bore 4, soldering layers "a" and "b" are formed prior to fitting on the bores 3 and 4.

During operation of the internal combustion engine, below the highest temperature such as 150 to 450° C. which the valve guide 7 or the valve seat 10 reaches, the soldering material may be dispersed into the fitted material such as the valve guide 7 or the valve seat 10.

For example, when the cylinder head 1 is made of Al-based material and when the fitted material is made of Fe-based material. ZN—Al soldering material which has a melting point of about 382° C., such as AH-Z95A under JIS (Japanese Industrial Standards) which contains 94 to 96% by weight of Zn, 4 to 6% by weight of Al, and below 0.3% by weight of other elements may be used.

Cu plating may be applied to the surface of the fitted material as base of the soldering material.

The soldering layers "a" and "b" are formed with metal plaiting, dipping, thermal spraying or powder coating, but the amount of the solder may be enough to close fine gaps formed by unevenness on the contacting surfaces. If the unevenness of the surfaces is $1.5\mu$ when they are fitted, the soldering layer may be $3\mu$ thick.

The valve guide 7 and the valve seat 10 on which the soldering layers "a" and "b" are formed are a press fit in the holding bores 3 and 4 as well as conventional means, and the internal combustion engine is then operated. Accordingly, the inner surfaces of the holding bores 3 and 4 on which the valve guide 7 and the valve seat 10 of the cylinder head 1 are fitted reaches operation temperature of the internal combustion engine within a short time, thereby melting the soldering layers "a" and "b" which have lower melting points than the operation temperature so as to flow into the gaps of the contacting surfaces.

The soldering layer as melted is dispersed in and melted with the cylinder head and the fitted material to each other to become an alloy which has a melting point higher than the highest temperature to during operation of the internal combustion engine.

An alloy thus made by dispersing and melting the soldering material is not melted during operation of the internal combustion engine again.

The soldering layer flows into the gaps on the inner surfaces of the holding bores 3 and 4 to close the gaps completely, so that the cylinder head 1, the valve guide 7 and the valve seat 10 become thermally integral material. Therefore, heat in the valve guide 7 and the valve seat 10 is suitably discharged via the cylinder head 1, thereby increasing durability and cooling effect as the whole cylinder head.

Figure 2:
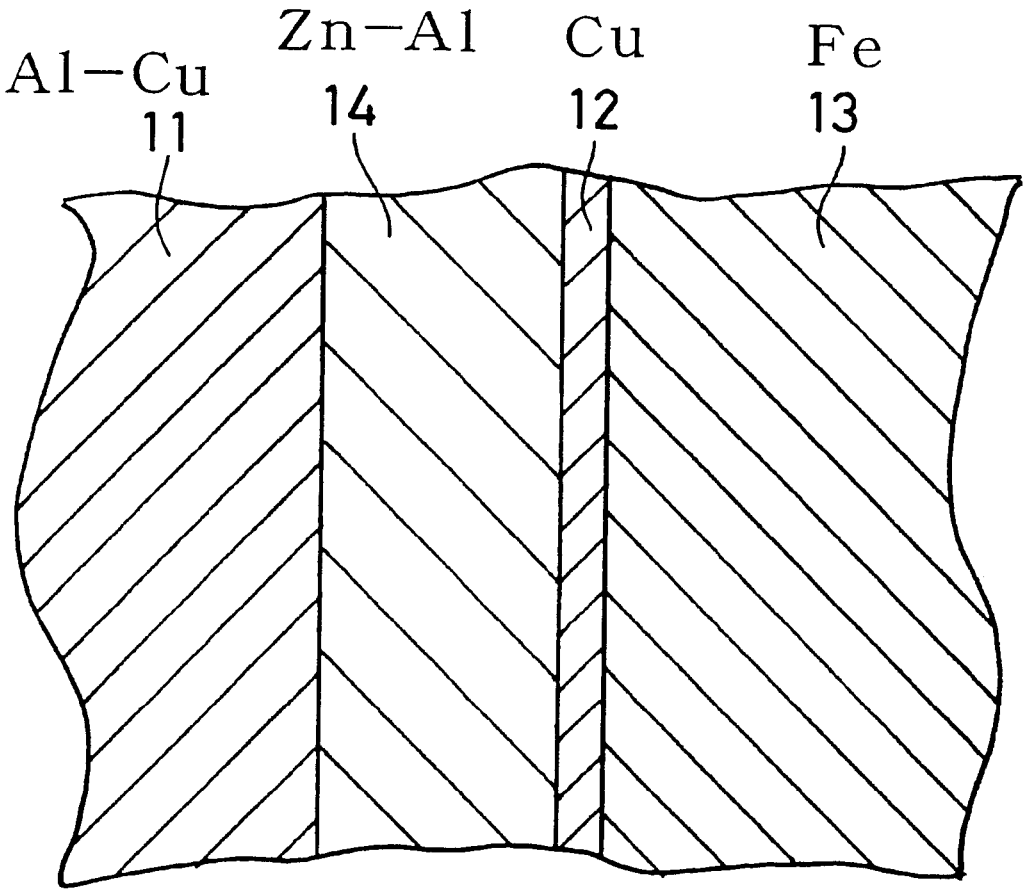
FIG. 2 is an enlarged sectional view of a bonded portion which comprises soldering material.

To make sure that the soldering layer is dispersed into and melted with the cylinder head to become an alloy which has a higher melting point that the original soldering material, as shown in FIG. 2, between a cylinder head material 11 and the fitted material 13 which is made of Fe-material and has a Cu plating layer 12 on the surface, the above ZN—Al soldering material 14 which contains 94 to 96% by weight of Zn, 4 to 6% by weight of Al and less than 0.3% by weight of other elements is held and pressed. It is totally heated to about 400° C., naturally cooled and qualitatively analyzed by an X-ray micro-analyzer.

Figure 3:
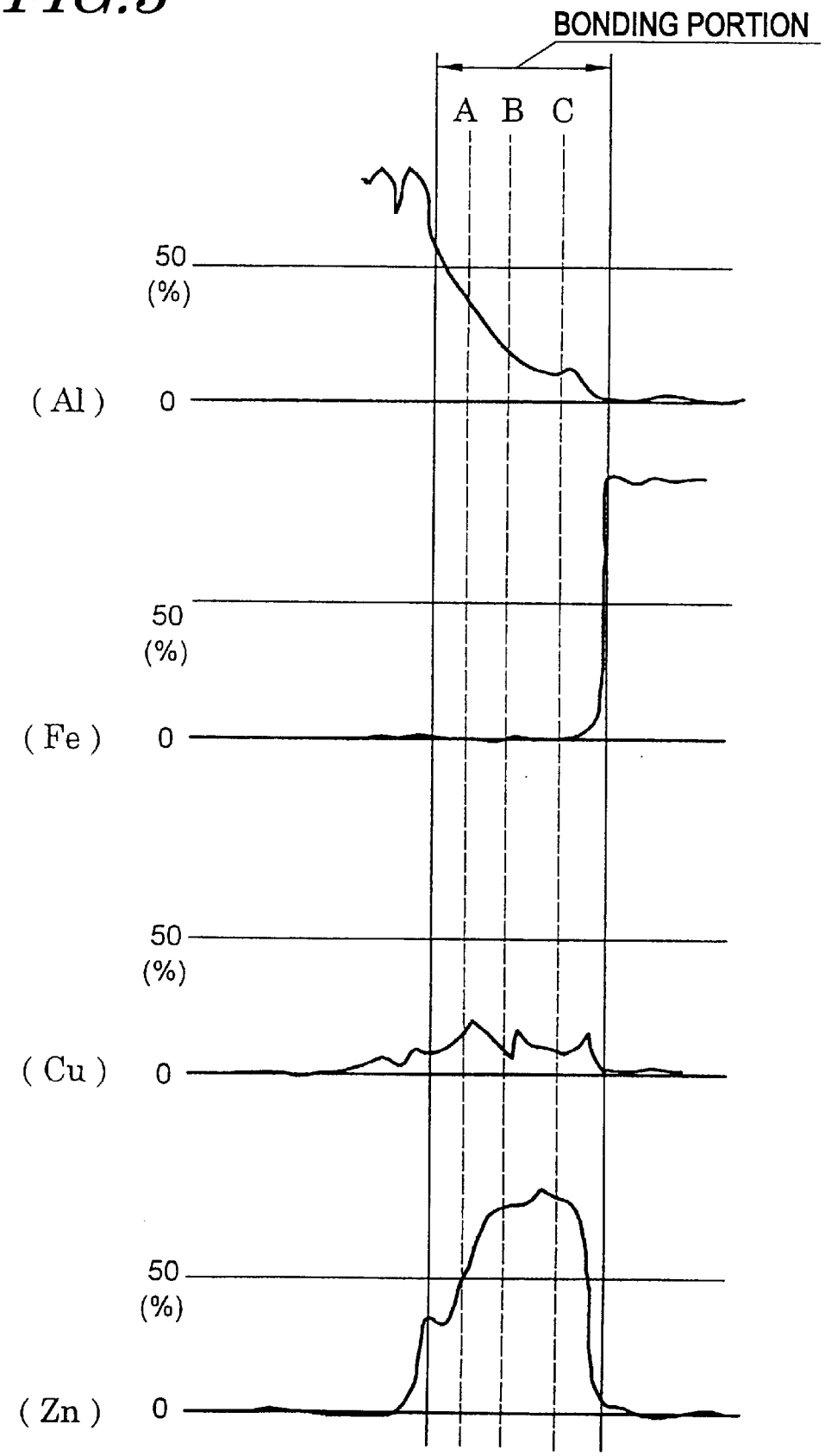
FIG. 3 is a graph which shows the results in which the bonding portion after melting of the soldering material is qualitatively analyzed by an X-ray micro-analyzer.

The results are shown in Table and FIG. 3.

Compositions and melting points are mentioned in optional points A, B, and C of a bonding portion.

TABLE

| | Al | Zn | Cu | melting point |
|---|---|---|---|---|
| A | 38% by weight | 50 | 12 | 540° C. |
| B | 17 | 75 | 8 | 480 |
| C | 10 | 82 | 8 | 460 |

As shown in FIG. 3 and Table, an alloy layer which comprises Al—Zn—Cu in a different ratio is formed from the cylinder head 11 to the fitted material. Any of the melting points are higher than those of the original soldering material 13. The alloy layer is subjected to 400 to 450° C. again, which is the highest temperature during operation of the internal combustion engine. The alloy layer which comprises Al—Zn—Cu is familiar with Fe-material of the cylinder head material 11 and the-fitted material 13, and mutual combining force between them becomes larger.

In this example, the soldering material 14 is dispersed and solved in both cylinder head material 11 and the fitted material 13. If high melting point alloy is finally available, it may be dispersed and melted into only one of them.

To confirm increasing effect in heat transfer of the present invention, Fe in which an interface has irregularities of about 1.5$\mu$ is engaged with Al alloy. The end is heated by a burner. Temperature in the other end is measured, and heat transfer in soldering layer is increased by about 70% compared with what has no soldering layer.

Figure 4:
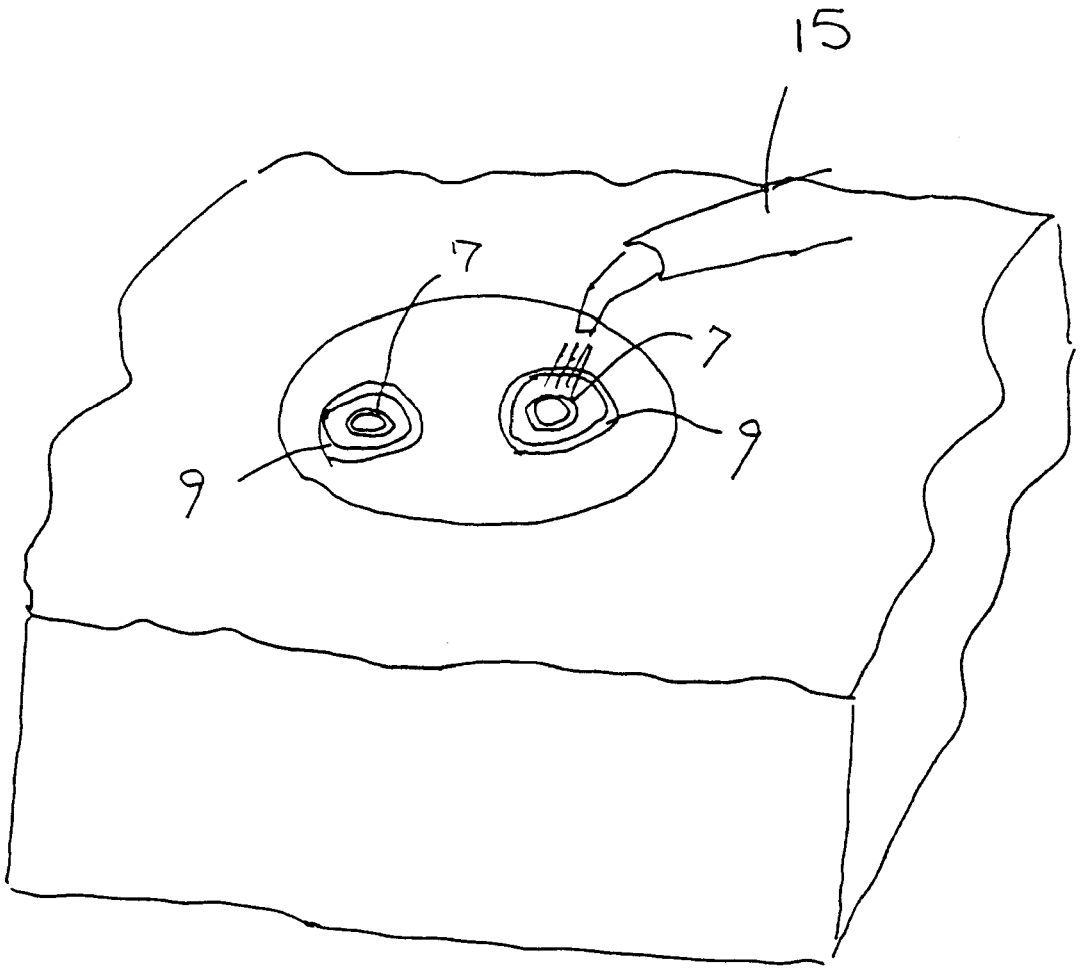
FIG. 4 illustrated the bottom of a cylinder head prior to insertion of a value and including a heating means.

In the foregoing embodiments, to melt the soldering material, operation temperature of the internal combustion engine is used, but prior to fixture to the engine, it may be melted by suitable heating means such as a burner 15, as shown in FIG. 4. Thus, soldering material which has somewhat higher melting point than the highest temperature during operation of the internal combustion engine can be used.

What is claimed is:

1. A method of increasing heat transfer of a fitted material of a cylinder head in an internal combustion engine, the method comprising the steps of:

dispersing and melting soldering material into the fitted material or the cylinder head at a lower temperature than the highest temperature which the fitted material reaches during operation of the internal combustion engine to form the soldering layer which becomes an alloy which has higher melting point than said highest temperature;

making a press fit of the fitted material into the holding bore of the cylinder head; and melting the soldering layer with operation of the internal combustion engine to close fine gaps on contacting surfaces of the holding bore and the fitted material and to disperse and melt said soldering material into the cylinder head and the fitted material to make an alloy which has higher melting point than said highest temperature;

wherein the cylinder head contains mainly Al, the fitted material contains mainly Fe, and the soldering layer contains 94 to 96% by weight of Zn, 4 to 6% by weight of Al and less than 0.3% by weight of other elements.

2. The method as defined in claim 1 wherein the fitted material comprises a valve guide in the cylinder head, and the holding bore comprises an upper holding bore vertically formed on an exhaust hole, the valve guide being inserted in the upper holding bore.

3. The method as defined in claim 1 wherein the fitted material comprises a valve seat on which a valve face of the valve is engaged, and the holding bore comprises a lower holding bore on which the valve seat is fixed.

4. The method as defined in claim 1 wherein the soldering layer is formed by metal plating, dipping, thermal spraying or powder coating.

5. The method as defined in claim 1, wherein a surface of the fitted material is plated by Cu prior to formation of the soldering layer.

6. The method as defined in claim 1, wherein the soldering material is dispersed into the fitted material or the cylinder head at a thickness of approximately twice the depth of the fine gaps on the contacting surfaces.

7. A method of increasing heat transfer of a fitted material of a cylinder head in an internal combustion engine, the method comprising the steps of:

dispersing and melting soldering material into the fitted material or the cylinder head to form the soldering layer which becomes an alloy which has higher melting point than the highest temperature which the fitted material reaches during operation of the internal combustion engine;

making a press fit of the fitted material into the holding bore of the cylinder head; and heating the soldering material by a heating means to close fine gaps on contacting surfaces of the holding bore and the fitted material and to disperse and melt said soldering material into the cylinder head and the fitted material to make an alloy which has higher melting point than said highest temperature, wherein the cylinder head contains mainly Al, the fitted material contains mainly Fe, and the soldering layer contains 94 to 96% by weight of Zn, 4 to 6% by weight of Al and less than 0.3% by weight of other elements.

8. The method as defined in claim 7 wherein the heating means comprises a burner.

9. The method as defined in claim 7 wherein the fitted material comprises a valve guide in the cylinder head, and the holding bore comprises an upper holding bore vertically formed on an exhaust hole, the valve guide being inserted in the upper holding bore.

10. The method as defined in claim 7 wherein the fitted material comprises a valve seat on which a valve face of the valve is engaged, and the holding bore comprises a lower holding bore on which the valve seat is fixed.

11. The method as defined in claim 7 wherein the soldering layer is formed by metal plating, dipping, thermal spraying or powder coating.

12. The method as defined in claim 7, wherein a surface of the fitted material is plated by Cu prior to formation of the soldering layer.

13. The method as defined in claim 7, wherein the soldering material is dispersed into the fitted material or the cylinder head at a thickness of approximately twice the depth of the fine gaps on the contacting surfaces.

14. A fitted portion of a fitted material of a cylinder head in an internal combustion engine, soldering material being dispersed in and melted with the cylinder head or the fitted material below the highest temperature which the fitted material reaches during operation of the internal combustion engine to form a soldering layer which comprises a higher melting point alloy than said highest temperature, wherein the cylinder head contains mainly Al, the fitted material contains mainly Fe, and the soldering layer contains 94 to 96% by weight of Zn, 4 to 6% by weight of Al and less than 0.3% by weight of other elements.

15. The fitted portion as defined in claim 14 wherein the fitted material comprises a valve guide in the cylinder head, and the holding bore comprises an upper holding bore vertically formed on an exhaust hole, the valve guide being inserted in the upper holding bore.

16. The fitted portion as defined in claim 14 wherein the fitted material comprises a valve seat on which a valve face of the valve is engaged, and the holding bore comprises a lower holding bore on which the valve seat is fixed.

17. The fitted portion as defined in claim 14 wherein the soldering layer is formed by metal plating, dipping, thermal spraying or powder coating.

18. The fitted portion as defined in claim 14, wherein a surface of the fitted material is plated with Cu prior to formation of the soldering layer.

19. The fitted portion as defined in claim 14, wherein the soldering material is dispersed into the fitted material or the cylinder head at a thickness of approximately twice the depth of the fine gaps on the contacting surfaces.

* * * * *